US011597986B2

(12) United States Patent
Irnich et al.

(10) Patent No.: US 11,597,986 B2
(45) Date of Patent: Mar. 7, 2023

(54) FLAT STEEL PRODUCT AND METHOD FOR PRODUCING SAME

(71) Applicants: ThyssenKrupp Steel Europe AG, Duisburg (DE); thyssenkrupp AG, Essen (DE)

(72) Inventors: Manuela Irnich, Rheinberg (DE); Rainer Fechte-Heinen, Bottrop (DE); Miriam Lange, Bochum (DE); Bernd Linke, Duisburg (DE); Jan-Hendrik Rudolph, Essen (DE); Richard G. Thiessen, Malden (NL)

(73) Assignees: ThyssenKrupp Steel Europe AG, Duisburg (DE); thyssenkrupp AG, Essen (DE)

( * ) Notice: Subject to any disclaimer, the term of this patent is extended or adjusted under 35 U.S.C. 154(b) by 87 days.

(21) Appl. No.: 17/251,302

(22) PCT Filed: Jun. 12, 2019

(86) PCT No.: PCT/EP2019/065323
§ 371 (c)(1),
(2) Date: Dec. 11, 2020

(87) PCT Pub. No.: WO2019/238741
PCT Pub. Date: Dec. 19, 2019

(65) Prior Publication Data

US 2021/0262069 A1 Aug. 26, 2021

(30) Foreign Application Priority Data

Jun. 12, 2018 (WO) ..... PCT/EP2018/065512

(51) Int. Cl.
*C22C 38/04* (2006.01)
*C22C 38/02* (2006.01)
(Continued)

(52) U.S. Cl.
CPC ..... *C22C 38/04* (2013.01); *C21D 8/0405* (2013.01); *C21D 8/0426* (2013.01);
(Continued)

(58) Field of Classification Search
None
See application file for complete search history.

(56) References Cited

U.S. PATENT DOCUMENTS 10,156,005 B2 12/2018 Takashima et al.
10,287,649 B2 5/2019 Bongards et al.
(Continued)

FOREIGN PATENT DOCUMENTS

CN 104662179 A 5/2015
CN 105452513 A 3/2016
(Continued)

OTHER PUBLICATIONS

Streicher et al., "Quenching and Partitioning Response of a Si-Added TRIP Sheet Steel", AHSSS Proceedings, 2004, pp. 51-62.

*Primary Examiner* — Anthony M Liang
(74) *Attorney, Agent, or Firm* — The Webb Law Firm

(57) ABSTRACT

The present invention relates to a flat steel product which has good deep-drawing ability, low edge-crack sensitivity and good bending behaviour. To this end, the flat steel product contains a steel which consists of (in wt %) 0.1-0.5% C, 1.0-3.0% Mn, 0.9-1.5% Si, up to 1.5% Al, up to 0.008% N, up to 0.020% P, up to 0.005% S, 0.01-1% Cr and optionally one or more of the following elements: up to 0.2% Mo, up to 0.01% B, up to 0.5% Cu, up to 0.5% Ni and optionally a total of 0.005-0.2% microalloying elements, the remainder being iron and unavoidable impurities, wherein 75<(Mn2+55*Cr)/Cr<3000 where Mn is the Mn content of the steel in wt % and Cr is the Cr content of the steel in wt %. The steel has a structure which consists of at least 80 area % martensite, of which at least 75 area % is tempered martensite and
(Continued)

at most 25 area % is non-tempered martensite, at least 5 volume % residual austenite, 0.5 to 10 area % ferrite and at most 5 area % bainite, wherein in the region of the phase boundary between tempered martensite and residual austenite there is a low-Mn ferrite seam which has a width of at least 4 nm and at most 12 nm and the Mn content of which is at most 50% of the average Mn content of the flat steel product. The flat steel product contains carbides with a length of less than or equal to 250 nm. The invention also relates to a method for producing a flat steel product according to the invention, in which method the structural characteristics of the flat steel product according to the invention are set by suitable heat treatment.

8 Claims, 1 Drawing Sheet

(51) Int. Cl.

| | |
|---|---|
| ***C22C 38/00*** | (2006.01) |
| ***C22C 38/20*** | (2006.01) |
| ***C22C 38/22*** | (2006.01) |
| ***C22C 38/32*** | (2006.01) |
| ***C22C 38/40*** | (2006.01) |
| ***C21D 8/04*** | (2006.01) |
| ***C23G 1/00*** | (2006.01) |
| ***C22C 38/06*** | (2006.01) |
| *C23C 2/06* | (2006.01) |

(52) U.S. Cl.

CPC ..... *C21D 8/0436* (2013.01); *C22C 38/001* (2013.01); *C22C 38/002* (2013.01); *C22C 38/02* (2013.01); *C22C 38/06* (2013.01); *C22C 38/20* (2013.01); *C22C 38/22* (2013.01); *C22C 38/32* (2013.01); *C22C 38/40* (2013.01); *C23G 1/00* (2013.01); *C21D 2211/001* (2013.01); *C21D 2211/002* (2013.01); *C21D 2211/005* (2013.01); *C21D 2211/008* (2013.01); *C23C 2/06* (2013.01)

(56) References Cited

U.S. PATENT DOCUMENTS

| | | | |
|---|---|---|---|
| 10,597,745 | B2 | 3/2020 | Drillet et al. |
| 2011/0198002 | A1 | 8/2011 | Nakagaito et al. |
| 2014/0377584 | A1 | 12/2014 | Hasegawa et al. |
| 2015/0203946 | A1 | 7/2015 | Hammer et al. |
| 2017/0107591 | A1 | 4/2017 | Takashima et al. |
| 2017/0130292 | A1 | 5/2017 | Mohanty et al. |
| 2019/0119774 | A1 | 4/2019 | Thiessen et al. |

FOREIGN PATENT DOCUMENTS

| | | | |
|---|---|---|---|
| CN | 105874086 | A | 8/2016 |
| CN | 106133155 | A | 11/2016 |
| CN | 107580634 | A | 1/2018 |
| EP | 2757171 | A1 | 7/2014 |
| EP | 3128023 | A1 | 2/2017 |
| JP | H0693340 | A | 4/1994 |
| WO | 2012156428 | A1 | 11/2012 |
| WO | 2016001898 | A2 | 1/2016 |
| WO | 2016177420 | A1 | 11/2016 |
| WO | 2017179372 | A1 | 10/2017 |
| WO | 2018055695 | A1 | 3/2018 |
| WO | 2019063081 | A1 | 4/2019 |

FLAT STEEL PRODUCT AND METHOD FOR PRODUCING SAME

CROSS-REFERENCE TO RELATED APPLICATIONS

This application is the United States national phase of International Application No. PCT/EP2019/065323 filed Jun. 12, 2019, and claims priority to International Application No. PCT/EP2018/065512 filed Jun. 12, 2018, the disclosures of which are hereby incorporated by reference in their entirety.

BACKGROUND OF THE INVENTION

Field of the Invention

The present application relates to a cold-rolled flat steel product, in particular a cold-rolled flat steel product for automobile engineering which has good deep-drawing ability, a low edge crack sensitivity and good bending behaviour and a method for producing such a flat steel product.

Description of Related Art

For automobile engineering, high and ultra high-strength steels are preferably used to reduce the vehicle weight, which should also have good formability in addition to high strength. The shape changing ability in the edge region is strongly reduced on sheets, which are exposed to shearing process such that the risk of the occurrence of edge cracks is increased in the case of further processing. A method for characterising the edge crack sensitivity is the hole expansion test according to ISO 16630. In contrast, in the case of bending test, the bending strength and the maximum deflection is determined up to a first crack. The angle obtained after the springback of the bent sample is designated as the bending angle and is a measure for the formability tendency of the tested material. In particular for complex constructive geometries, high requirements are placed on the deep-drawing ability of the steels. The cupping test according to DIN 8584-3 offers a method for assessing the deep-drawing ability which delivers conclusions regarding the deep-drawing ability of the material by determining the maximum deep-drawing ratio (limiting drawing ratio Bmax). Both the elongation at break and the maximum deep-drawing ratio usually decrease with increasing strength.

When flat steel products are mentioned in the present case, steel strips, steel sheets or blanks produced therefrom such as panels are understood.

A method for producing flat steel products is known from WO 2012/156428 A1, in which the flat steel products are subjected to a heat treatment, in which the flat steel products are cooled after austenitisation to the cooling stop temperature, held and then reheated in one phase at a heating rate Theta_P1 to a temperature TP. The flat steel products have a yield strength of 600 to 1400 MPa, a tensile strength of at least 1200 MPa, an elongation A50 of 10 to 30%, a hole expansion of 50 to 120% and a bending angle of 100 to 180°. The flat steel products consist of 0.10-0.50 wt % C, 0.1-2.5 wt % Si, 1.0-3.5 wt % Mn, up to 2.5 wt % Al, up to 0.020 wt % P, up to 0.003 wt % S, up to 0.02 wt % N, and optionally 0.1-0.5 wt % Cr, 0.1-0.3 wt % Mo, 0.0005-0.005 wt % B, up to 0.01 wt % Ca, 0.01-0.1 wt % V, 0.001-0.15 wt % Ti, 0.02-0.05 wt % Nb, wherein the sum of the contents of V, Ti and Nb is less than or equal to 0.2 wt %. The structure of the flat steel products has less than 5% ferrite, less than 10% bainite, 5-70% non-tempered martensite, 5-30% residual austenite and 25-80% tempered martensite. In contrast, it is not known from WO 2012/156428 A1 how a high strength and a good deep-drawing ability can be achieved at the same time.

When information is given in the present case about alloy contents and compositions, this relates to the weight or the mass, unless otherwise explicitly stated. Unless otherwise mentioned in this regard, the information about the structure proportions for the structure constituents of martensite, ferrite and bainite in the present case relates to area % and for residual austenite to vol %.

SUMMARY OF THE INVENTION

Against the background of the prior art, the object of the invention was to indicate an ultra high-strength flat steel product with optimised mechanical properties, in particular very good forming properties, in particular good deep-drawing ability with simultaneously high strength.

A further object of the invention was to provide a method for producing such a flat steel product. This method should in particular be suited for being incorporated into a process for hot dip coating.

DESCRIPTION OF THE INVENTION

Figure 1:
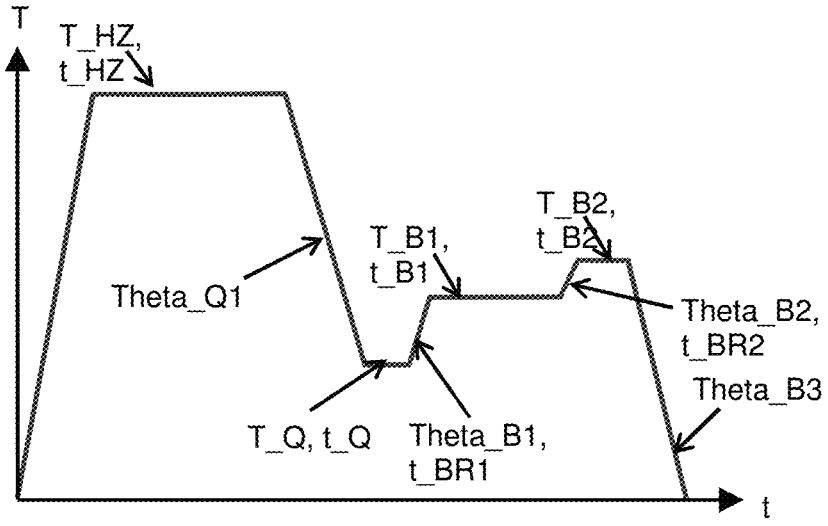
FIG. 1 schematically shows an embodiment of a heating profile used in the method according to the invention.

A flat steel product according to the invention contains a steel, which consists of (in wt %)

| | |
|---|---|
| 0.1-0.5 % | C, |
| 1.0-3.0 % | Mn, |
| 0.9-1.5 % | Si, |
| up to 1.5 % | Al, |
| up to 0.008 %, | N, |
| up to 0.020 %, | P, |
| up to 0.005 %, | S, |
| 0.01-1 % | Cr, |

as well as optionally consisting of one or more of the following elements

| | |
|---|---|
| up to 0.2 % | Mo, |
| up to 0.01 % | B, |
| up to 0.5 % | Cu, |
| up to 0.5 % | Ni |

and optionally of microalloying elements in total of 0.005-0.2% and the remainder of iron and unavoidable impurities, wherein the following applies:

$$75 \leq (Mn^2+55*Cr)/Cr \leq 3000$$

where Mn is the Mn content of the steel in wt %, Cr is the Cr content of the steel in wt %.

A flat steel product according to the invention has a structure, which consists of at least 80 area % of martensite, of which at least 75 area % is tempered martensite and at most 25 area % is non-tempered martensite, at least 5 vol % of residual austenite,
0.5 to 10 area % of ferrite and
at most 5 area % of bainite In this case, it is essential for good mechanical properties that in the region of the phase boundaries between tempered martensite and residual austenite there is a low-Mn ferrite seam. In this ferrite seam, the Mn content is at most 50% of the average total Mn content of the flat steel product. The width of the low-Mn ferrite seam is at least 4 nm, preferably more than 8 nm, and at most 12 nm, preferably less than 10 nm. In addition, carbides are present in a flat steel product according to the invention, whose length is equal to or less than 250 nm, preferably less than 175 nm.

A flat steel product according to the invention is characterised by a tensile strength Rm of 900 to 1500 MPa, a yield strength Rp02, which is equal to or more than 700 MPa and less than the tensile strength of the flat steel product, an elongation A80 of 7 to 25%, a bending angle, which is greater than 80°, a hole expansion, which is greater than 25% and a maximum deep-drawing ratio $\beta_{max}$ are determined, for which the following applies: $\beta_{max} \geq -1.9 \cdot 10^{-6} \times (R_m)^2 + 3.5 \cdot 10^{-3} \times R_m + 0.5$ with Rm: Tensile strength of the flat steel product in MPa, wherein the tensile strength, the yield strength and the elongation in the tensile test according to DIN EN ISO 6892-1 (sample shape 2) from February 2017, the bending angle according to VDA238-100 of December 2010, the hole expansion according to ISO 16630 of October 2017 and the maximum deep-drawing ratio, Bmax according to DIN 8584-3 from September 2003 are determined.

The carbon content of the steel of a flat steel product according to the invention is 0.1-0.5 wt %. The carbon contributes to the formation and stabilisation of the austenite in the steel of a flat steel product according to the invention. In particular during the first cooling taking place after the austenitisation and during the subsequent partitioning annealing, C contents of at least 0.1 wt %, preferably of at least 0.12 wt % contribute to the stabilisation of the austenitic phase, whereby it is possible to ensure a residual austenite proportion of at least 5 vol % in the flat steel product according to the invention. Moreover, the C content has a strong influence on the strength of the martensite. This applies both to the strength of the martensite, which develops during the first quenching, and to the strength of the martensite, which is formed during the second quenching occurring after the partitioning annealing. In order to utilise the influence of the carbon on the strength of the martensite, the C content is at least 0.1 wt %. With increasing C content, the martensite start temperature Ms is pushed to lower temperatures. A C content above 0.5 wt % could therefore lead to not enough martensite being formed during quenching. In addition, a high C content can lead to the formation of large brittle carbides. The processability, in particular the weldability, is negatively affected with higher C contents, which is why the C content should be at most 0.5 wt %, preferably at most 0.4 wt %.

Manganese (Mn) is important as an alloy element for the toughness of the steel and for avoiding the formation of the structure constituent perlite during cooling. The Mn content of the steel of a flat steel product according to the invention is at least 1.0 wt %, in particular at least 1.9 wt % in order to provide a perlite-free structure consisting of martensite and residual austenite for the further process steps after the first quenching. An excessively low Mn content would also lead to it not being possible to form a low-Mn ferrite seam. The positive influences of Mn can be particularly reliably utilised in contents of preferably at least 1.9 wt %. With increasing Mn content, in contrast, the weldability of a flat steel product according to the invention deteriorates and the risk of the occurrence of strong segregations increases. Segregations are chemical inhomogeneities of the composition formed during the hardening process in the form of macroscopic or microscopic separations. In order to reduce segregations and to ensure good weldability, the Mn content of the steel of a flat steel product according to the invention is limited to at most 3.0 wt %, preferably to at most 2.7 wt %.

Silicon (Si) as an alloy element supports the suppression of cementite formation. Cementite is an iron carbide. Through the formation of cementite, carbon in the form of iron carbide is bonded and is no longer available as an interstitially dissolved carbon for the stabilisation of the residual austenite. As a result, the elongation of the flat steel product deteriorates since residual austenite contributes to the improvement of the elongation. A similar effect in relation to the stabilisation of the residual austenite can also be achieved by alloying aluminium. In order to utilise the positive effect of Si, at least 0.9 wt % Si should be present in the steel of the flat steel product according to the invention. Since a high Si content can, however, negatively affect the surface quality of the flat steel product, the steel should not contain more than 1.5 wt %, preferably less than 1.5 wt % Si.

Aluminium (Al) can be added to the steel of a flat steel product according to the invention for deoxidation and to bind nitrogen, if nitrogen is present in the steel, in contents of up to 1.5 wt %. Aluminium can also be added to suppress the cementite formation. However, Al increases the austenitisation temperature of the steel. If higher annealing temperatures are supposed to be set for the austenitisation, Al up to 1.5 wt % can be alloyed. Since aluminium increases the annealing temperature required for complete austenitisation and in the case of Al contents above 1.5 wt % complete austenitisation is possible only with difficulty, the Al content of the steel of a flat steel product according to the invention is limited to at most 1.5 wt %, preferably at most 1.0 wt %. If a low austenitisation temperature is supposed to be set, Al contents of at least 0.01 wt %, in particular of 0.01 to 0.1 wt % have proven expedient.

Phosphorous (P), sulphur (S) and nitrogen (N) act negatively on the mechanical-technological properties of flat steel products according to the invention. Thus, P acts unfavourably on weldability, which is why the P content should be at most 0.02 wt %, preferably less than 0.02 wt %. In the case of higher concentrations, S leads to the formation of MnS or to the formation of (Mn, Fe)S which act negatively on the elongation. Therefore, the S content is limited to values of at most 0.005 wt %, preferably less than 0.005 wt %. Nitrogen bonded to nitrides can negatively affect the formability, which is why the N content should be limited to at most 0.008 wt %, preferably to less than 0.008 wt %.

Chromium (Cr) is present in contents of 0.01 up to 1.0 wt % in the steel. Chromium is an effective inhibitor of perlite and contributes to the strength. Therefore, at least 0.01 wt % of Cr, preferably at least 0.1 wt % of Cr should be contained in the steel according to the invention. In the case of Cr contents of more than 1.0 wt %, the weldability of a flat steel product according to the invention deteriorates and the risk of the occurrence of a pronounced grain boundary oxidation, which leads to the deterioration of the surface quality, is increased. Therefore, the Cr content is limited to at most 1.0 wt %, preferably at most 0.50 wt %, particularly preferably to less than 0.2 wt %.

Furthermore, the knowledge underlying the invention is that the maintenance of a determined ratio of Mn and Cr favourably affects the formation of a low-Mn ferrite seam along the phase boundary of residual austenite to tempered martensite. Thus, a low-Mn ferrite seam along the phase boundary of residual austenite to tempered martensite can be set when the following condition is met:

$$75 \leq (Mn^2+55*Cr)/Cr \leq 3000$$

where Mn is the Mn content of the steel in wt % and Cr: Cr content of the steel in wt %. If the chromium content is too high in comparison to the Mn content, it may lead to the grain boundaries being covered with chromium carbides. This is not desired since the formation of the low-Mn ferrite seam would be prevented by a reduced movability of the phase boundary. If, however, the Mn content is selected to be too great in comparison to the chromium content, this results in a premature saturation of the austenite in Mn and the diffusion of the manganese comes to a standstill. A low-Mn ferrite seam cannot be formed due to the still high local Mn concentration. Through the lack of the ferrite seam, the forming properties and in particular the maximum deep-drawing ratio $\beta_{max}$ would deteriorate.

Optionally, one or a plurality of elements from the group of molybdenum (Mo), boron (B) and copper (Cu) may be present in the steel of a flat steel product according to the invention to improve the mechanical-technological properties.

Molybdenum (Mo) can also optionally be contained in the steel of a flat steel product according to the invention in contents of up to 0.2 wt %, preferably less than 0.2 wt % in order to prevent the formation of perlite.

Boron (B) can be contained as an optional alloy element in contents of up to 0.01 wt % in the steel of a flat steel product according to the invention. Boron segregates at the phase boundaries and therefore blocks their movement. This supports the formation of a fine-grained structure which improves the mechanical properties of the flat steel product. When alloying boron, there should be enough Ti to bind N which prevents the formation of harmful boron nitrides, namely Ti>3.42*N. From a technical viewpoint, the lower limit for boron is 0.0003%.

Copper (Cu) can be contained as an optional alloy element in contents of up to 0.5 wt % in the flat steel product according to the invention. The yield strength and strength can be increased by Cu. In order to effectively utilise the strength-increasing effect of Cu, Cu can be added preferably in contents of at least 0.03 wt %. Additionally, the resistance to atmospheric corrosion is increased with these contents. At the same time, however, there is a notable decrease in elongation at break with increasing Cu contents. Moreover, the weldability with Cu contents of greater than 0.5 wt % is notably reduced and the tendency for red brittleness increases which is why the Cu content is up to 0.5 wt %, preferably 0.2 wt %.

Nickel (Ni) can be contained as an optional alloy element in contents of up to 0.5 wt % in the steel of a flat steel product according to the invention. Like chromium, it is also an inhibitor of the perlite and effective even in small quantities. In the case of optional alloying with nickel of preferably at least 0.02 wt %, in particular at least 0.05 wt %, this supporting effect can be achieved. In regard to the desired setting of the mechanical properties, it is also expedient to limit the Ni content to 0.5 wt %, with Ni contents of at most 0.2 wt %, in particular 0.1 wt % having been found to be particularly practical.

Optionally, steels of flat steel products according to the invention contain one or a plurality of microalloying elements. Microalloying elements are understood in the present case as the elements titanium (Ti), niobium (Nb) and vanadium (V). Titanium and/or niobium are preferably used here. The microalloying elements can form carbides with carbon which contributes to a higher strength in the form of very finely distributed precipitations. In the case of a content of microalloying elements of in total at least 0.005 wt %, precipitations may develop which lead to freezing of grain and phase boundaries during austenitisation. At the same time, however, carbon, which, in atomic form, is favourable for stabilising the residual austenite, is bonded as carbide. To ensure sufficient stabilisation of the residual austenite, the concentration of microalloying elements in total should not be more than 0.2 wt %. In a preferred embodiment, the total of Ti and/or Nb is 0.005-0.2 wt %.

In a preferred embodiment, the flat steel product according to the invention is a cold-rolled flat steel product.

In a further preferred embodiment, the flat steel products can optionally be provided with a metallic coating for the purposes of corrosion protection. Zn-based coatings are in particular suitable for this purpose. The coating can in particular be applied by hot dip coating.

The method according to the invention for producing an ultra-high strength flat steel product comprises at least the following work steps:

a) Providing a slab, which consists of a steel, which, in addition to iron and unavoidable impurities, consists of (in wt %)
   0.1-0.5% C, preferably 0.12-0.4 wt %, 1.0-3.0% Mn, preferably 1.9-2.7 wt % Mn, 0.9-1.5% Si, up to 1.5% Al, up to 0.008% N, up to 0.020% P, up to 0.005% S, 0.01 to 1% Cr, as well as optionally of one or more of the following elements: up to 0.2% Mo, up to 0.01% B, up to 0.5% Cu, up to 0.5% Ni as well as optionally of in total 0.005-0.2% of microalloying elements, preferably of in total 0.005-0.2% Ti and/or Nb, wherein the following applies: $75 \leq (Mn^2+55*Cr)/Cr \leq 3000$, where Mn is the Mn content of the steel in wt %, Cr is the Cr content of the steel in wt %;
b) Heating the slab to temperatures of 1000-1300° C. and hot rolling the slab into a hot strip, wherein the end rolling temperature T_ET is greater than 850° C.;
c) Cooling the hot strip within at most 25 seconds to a coiling temperature T_HT of 400 to 620° C., and winding the hot strip into a coil;
d) Pickling the hot-rolled flat steel product;
e) Cold-rolling the hot-rolled flat steel product;
f) Heating the cold-rolled flat steel product to a holding zone temperature T_HZ of at least 15° C. above the A3 temperature of the steel and is at most 950° C., wherein the heating takes place either
   f1) in one phase at an average heating rate of 2-10 K/s or
   f2) in two phases at a first heating speed Theta_H1 of 5-50 K/s up to a conversion temperature T_W of 200-400° C. and above the conversion temperature T_W at a second heating speed Theta_H2 of 2-10 K/s;
g) Holding the flat steel product for a duration t_HZ of 5-15 seconds at the holding zone temperature T_HZ;
h) Cooling the flat steel product from the holding zone temperature T_HZ to a cooling stop temperature T_Q that is between the martensite start temperature T_MS and a temperature that is 175° C. lower than T_MS, at either
   h1) a cooling rate Theta_Q1 which is at least 30 K/s; or
   h2) a first cooling rate Theta_LK of less than 30 K/s for a first cooling to an intermediate temperature T_LK of not lower than 650° C., and a second cooling rate Theta_Q2 for a second cooling from T_L to T_Q, wherein Theta_Q2 is at least 30 K/s;

i) Holding the flat steel product at the cooling stop temperature T_Q for 1-60 seconds;

j) Heating the flat steel product at a first heating rate Theta_B1 of between 5 and 100 K/s, to a first treatment temperature T_B1 of at least T_Q+10° C. and at most 450° C., holding the flat steel product at the first treatment temperature T_B1 for a duration t_B1 of 8.5 seconds to 245 seconds, heating the flat steel product at a second heating rate Theta_B2 of between 2 and 50 K/s, to a second treatment temperature T_B2 of at least T_B1+10° C. and at most 500° C., optionally holding the flat steel product at the treatment temperature T_B2 for a duration t_B2 of up to 34 seconds, wherein the entire treatment time t_B2 for the heating and the isothermic holding is in total between 10 and 250 seconds;

k) Optionally coating the flat steel product in a Zn-based coating bath;

l) Cooling the flat steel product to room temperature at a cooling rate Theta_B3 of at least 5 K/s.

In work step a), a slab produced in a conventional manner is provided which consists of a steel of the composition mentioned in work step a).

In work step b), the slab is heated to temperatures of 1000-1300° C. and rolled into a hot strip. The hot rolling takes place with an end rolling temperature T_ET greater than 850° C. in an otherwise usual manner. The end rolling temperature T_ET should be higher than 850° C. in order to avoid the formation of rough, polygonal ferrite grains during the rolling operation.

In work step c), the hot strip is cooled after the hot rolling and before the coiling and then wound at the coiling temperature T_HT into a coil. In order to reduce the formation of polygonal ferrite or preferably to completely suppress it, the cooling takes place within a time period t_RG equal to or less than 25 seconds, i.e. within at most 25 seconds. In this case, t_RG is the time period, which begins after the conclusion of the rolling operation, i.e. after the last rolling pass and ends after the conclusion of the cooling operation, i.e. upon reaching the coiling temperature T_HT. The development of polygonal ferrite can be particularly effectively minimised when t_RG is at most 18 seconds, preferably at most 15 seconds. Typically, t_RG is, for process-related reasons, at least 2 seconds, generally at least 5 seconds.

In order to prevent the formation of the undesired structure constituent perlite, the coiling takes place at a coiling temperature T_HT of at most 620° C. In a preferred embodiment, the coiling temperature T_HT is set to at most 600° C. which also has a positive effect on the avoidance of polygonal ferrite. In this case, coiling temperatures of at most 580° C. are particularly preferred in order to increase the proportion of bainite in the structure of the hot strip. If the coiling temperature is selected such that it is between 620° C. and 580° C., then the proportion of bainite and bainitic ferrite increases with decreasing coiling temperature. Therefore, an identical structure without large hardness differences can be achieved which allows narrow thickness and width tolerances to be maintained during the subsequent cold rolling step. A further positive effect of the low coiling temperatures is the reduced susceptibility to grain boundary oxidation. It generally applies that the higher the coiling temperature, the likelier oxygen-affine elements diffuse, such as e.g. Si, Cr or Mn in relation to the grain boundary and form stable oxides there which reduce the surface quality and make an optional subsequent coating difficult. However, the coiling temperature T_HT should also not be selected to be lower than 400° C. since in the case of lower coiling temperatures, the cold rollability is negatively affected due to circumferential martensite formation. Martensite represents a particularly hard and brittle phase which negatively influences the cold rollability. In addition, in the case of lower coiling temperatures, not enough thermal energy is provided to redistribute the Mn.

When the cooling time t_RG and coiling temperature T_HT according to the invention are maintained, a largely bainitic structure is produced in the first minute of coiling. This consists primarily of very finely distributed bainitic ferrite and very finely distributed austenite, wherein the grain sizes of the ferrite and the austenite are each in the nanometric range. In this case, the shortest distance between two phases is typically less than or equal to 20 μm. Mn is a strong austenite former, which is why there is a driving force for a repositioning of Mn atoms from the ferritic structure constituents into the austenite grains. During the cooling in the coil, which takes place very slowly, Mn diffuses from the ferrite into the austenite. As a result, the ferritic structure constituents lack Mn in one region which lies directly behind the phase boundary surface of ferrite to austenite. This region depleted in Mn is a few nanometres wide. At the same time, Mn is enriched in the austenite grains directly behind the phase boundary. The diffusion operation is locally limited to a region a few nanometres wide around the phase boundary between austenite and ferrite since the volume diffusion of Mn into a temperature range of between 620° C. and 400° C. takes place very slowly. With progressive cooling to temperatures of below 400° C., the austenite partially decomposes into iron carbides. However, this has no effect on the redistribution of Mn since the diffusion speed of Mn below 400° C. is too low and also does not provide any thermodynamic driving force for homogenisation.

The diffusion operation of the Mn is supported by very low cooling speeds and correspondingly long hold times. The setting of low cooling speeds can in a preferred embodiment take place by cooling the hot strip in the coil in the air, in particular stagnant air.

In a further preferred embodiment, the coil weight can be utilised to influence the cooling in the coil. The heavier the coil is, the slower the cooling takes place because the ratio of coil mass to coil surface increases. Thus, slow cooling and therefore a redistribution of Mn in the hot strip can be supported when the coil mass m_CG is at least 10 t, particularly preferably at least 15 t, quite particularly preferably at least 20 t.

After the cooling in the coil, the hot-rolled flat steel product is pickled in a conventional manner (work step d)) and then subjected to cold rolling in a conventional manner (work step e)).

The cold-rolled flat steel product is heated in work step f) to an annealing temperature T_HZ which can also be designated as the holding zone temperature. The heating takes place either in one phase at an average heating rate of 2-10 K/s, preferably 5-10 K/s. Alternatively, the heating can also take place in two phases. In this case, the flat steel product is firstly heated until reaching a conversion temperature T_W, which is 200-400° C., at a heating speed Theta_H1 of 5-50 K/s. The heating up to reaching the holding zone temperature T_HZ takes place above the conversion temperature T_W at a heating speed Theta_H2 of 2-10 K/s. During the two-phase heating, the first heating speed Theta_H1 is not equal to the second heating speed Theta_H2. Theta_H2 is preferably less than Theta_H1.

In a preferred embodiment, the flat steel product is heated in a continuous furnace. In a particularly preferred embodiment, the flat steel product is heated in a furnace which is equipped with ceramic radiant tubes which in particular is advantageous for reaching strip temperatures above 900° C.

The holding zone temperature T_HZ is at least 15° C., preferably more than 15° C., above the A3 temperature of the steel, in order to enable a complete structure conversion in the austenite. The A3 temperature is analysis-dependent and can be estimated with the help of the following empirical equation:

$$A3[°\ C.]=910-15.2\%\ Ni+44.7\%\ Si+31.5\%\ Mo-21.1\%\ Mn-203*\sqrt{\%C}$$

with % C=C content of the steel in wt %, % Ni=Ni content of the steel in wt %, % Si=Si content of the steel in wt %, % Mo=Mo content of the steel in wt %, % Mn=Mn content of the steel in wt %.

The holding zone temperature T_HZ is limited to at most 950° C. since, in the case of higher temperatures and longer hold times, the Mn enrichment in the austenite already produced in the hot strip and the Mn depletion in the ferrite could be rehomogenised. In addition, operational costs can be saved through annealing temperatures limited to 950° C.

The flat steel product is held in work step g) for a hold time t_HZ of 5-15 seconds at the holding zone temperature T_HZ. The hold duration t_HZ should not exceed 15 seconds in order to avoid the formation of a rough austenite grain and an unregulated austenite grain growth and therefore negative effects on the formability of the flat steel product. The hold duration should last at least 5 seconds in order to achieve a complete conversion into austenite and a homogeneous C distribution in the austenite. The formation of the low-Mn zone is also negatively influenced by a long t_HZ and the associated Mn homogenisation. An excessively long hold time t_HZ leads to an equal distribution of the manganese and therefore not to the formation of the low-Mn ferrite seam.

In work step h), the flat steel product is cooled from the holding zone temperature T_HZ to a cooling stop temperature T_Q. Through the cooling in work step h), martensite develops, which is also designated as primary martensite. The cooling can take place either in one phase or two phases. In both cases, quick cooling at a cooling rate Theta_Q of at least 30 K/s takes place at least over a part of the temperature range between T_HZ and T_Q. To better distinguish between one-phase and two-phase cooling, the quick cooling rate Theta_Q is designated as Theta_Q1 in the case of one-phase cooling and in the case of two-phase cooling as Theta_Q2. In the case of one-phase cooling, the flat steel product is cooled at only a cooling rate Theta_Q1, which is at least 30 K/s, from T_HZ to T_Q. The maximum value for Theta_Q1 is 1000 K/s, preferably a maximum of 500 K/s, particularly preferably a maximum of 200 K/s in order to ensure a uniform temperature distribution. The cooling takes place at at least 30 K/s in order to avoid the conversion into bainite and ferrite proportions of more than 10%.

In the case of two-phase cooling, the flat steel product is firstly cooled at a first cooling rate Theta_LK, which is less than 30 K/s, to an intermediate temperature T_LK. In a preferred embodiment, Theta_LK is greater than 0.1 K/s in order to avoid the formation of ferrite proportions of more than 10% as far as possible. T_LK is in this case less than T_HZ and not lower than 650° C. in order to avoid the formation of ferrite proportions of more than 10%. After reaching the intermediate temperature T_LK, the further cooling takes place uninterrupted to the cooling stop temperature T_Q at a second cooling rate Theta_Q2 which is at least 30 K/s. The maximum value for Theta_Q2 is 1000 K/s, preferably a maximum of 500 K/s, particularly preferably a maximum of 200 K/s in order to ensure a uniform temperature distribution. The two-phase cooling is also carried out in the temperature range below 650° C. at at least 30 K/s in order to avoid the formation of ferrite proportions of more than 10% and a bainitic conversion. The ferritic and the bainitic conversion are particularly reliably limited when the time t_LK for the cooling from T_HZ to T_LK is also no more than 30 seconds.

To control the martensite formation, the cooling stop temperature T_Q is selected such that T_Q is between the martensite start temperature T_MS and a temperature which is up to 175° C. less than T_MS. The following applies:

$$(T_MS-175°\ C.)<T_Q<T_MS.$$

In a preferred embodiment, T_Q can be selected such that T_Q is between a temperature which is less than T_MS by 75° C. and a temperature which is less than T_MS by 150° C.:

$$(T_MS-150°\ C.)<T_Q<(T_MS-75°\ C.).$$

The martensite start temperature T_MS is understood here as the temperature at which the conversion from austenite into martensite begins. The martensite start temperature can be estimated with the help of the following equation:

$$T_MS[°\ C.]=539°\ C.+(-423\%\ C-30.4\%\ Mn-7.5\%\ Si+30\%\ Al)°\ C./wt\ \%$$

with % C=C content of the steel in wt %, % Mn=Mn content of the steel in wt %, % Si=Si content of the steel in wt %, % Al=Al content of the steel in wt %.

Manganese reduces the martensite start temperature because Mn as an austenite former inhibits the thermodynamic driving force for the martensite formation. Therefore, the martensite formation is promoted by reduced Mn contents. For this reason, the first martensite lancets form, preferably in regions which are low in Mn, whereas regions with high Mn contents primarily remain austenitic. Therefore, the phase boundaries of austenite to martensite are preferably at points of local Mn enrichments and local Mn depletions. These points of local Mn enrichments and local Mn depletions have already been produced during the hot strip production process and are present finely distributed in the material. Typically, the points of local Mn enrichments and local Mn depletions are distributed in the material at a distance of less than 5 μm, preferably less than 1 μm from one another.

The flat steel product cooled to T_Q is held in work step i) for a duration t_Q, which is 1-60 seconds, at the cooling stop temperature T_Q in order to achieve homogenisation of the temperature distribution in the flat steel product both over the thickness and over the width. Homogeneous distribution of the temperature over the thickness and width of the flat steel product favours the formation of a particularly fine structure. Typically, the average grain size is less than 20 μm. In some cases, structures with average grain sizes of less than 15 μm or even less than 10 μm can also arise. Typically, a uniform structure consisting of primary martensite and residual austenite is present over the thickness and width of the flat steel product which favourably affects the formability of the cold-rolled and annealed end product, here of the coil and the cut sheets. The temperature distribution can be particularly reliably achieved when the flat steel product is held for at least 5 seconds, particularly preferably at least 10 second at T_Q.

After holding at T_Q, the flat steel product is reheated in work step j). During heating, the flat steel product is firstly heated at a first heating rate Theta_B1, which is between 5 and 100 K/s, to a first treatment temperature T_B1, which is above the cooling stop temperature T_Q by at least 10° C. The treatment temperature T_B1 is at least T_Q+10° C., preferably T_Q+15° C., particularly preferably T_Q+20° C., and at most 450° C. Afterwards, the flat steel product is heated at a second heating rate Theta_B2, which is between 2 and 50 K/s, to a second treatment temperature T_B2, which is above the first treatment temperature T_B1 at least by 10° C. The second treatment temperature T_B2 is at least T_B1+10° C., preferably at least T_B1+15° C., particularly preferably at least T_B1+20° C. The second treatment temperature T_B2 is at most 500° C. The flat steel product can be held isothermically in a subsequent optional treatment step at the second treatment temperature T_B2 for a duration t_B2 of up to 34 seconds. The entire treatment duration t_BT, which includes the heating to T_B1, the isothermic holding at T_B1, the heating to T_B2 and the optional holding at T_B2, is in this case between 10 and 250 seconds.

During the heating to the first treatment temperature T_B1, the residual austenite is enriched with carbon from the oversaturated primary martensite. In a preferred embodiment, the ratio of primary martensite to residual austenite is in this case greater than 2:1 since such a ratio has proven to be particularly favourable for achieving good forming behaviour. In the case of a ratio of primary martensite to residual austenite greater than 2:1, the effect of a high thermodynamic driving force can be utilised in order to support the displacement of the carbon in the residual austenite. Due to the comparatively low atomic mass and the high diffusability of the carbon, in particular in the body-centred cubic lattice of martensite, the diffusion process begins as early as from the cooling stop temperature T_Q and therefore at the beginning of the martensitic conversion. Since the diffusability of the carbon in the face-centred cubic lattice of the austenite is substantially less than in the martensite, C-atoms are enriched at the phase boundary between the primary martensite and the austenite. This enrichment leads to a local rise in the C concentration at this point which can be multiple weight percentage points. In order to ensure sufficient enrichment of C atoms at the phase boundary between the primary martensite and the austenite, the first treatment temperature T_B1 should be at least 10° C., preferably at least 15° C., particularly preferably at least 20° C. above the cooling stop temperature T_Q. In order to prevent an excessively high local rise in the C concentration at this point, T_B1 should not be above 450° C., preferably not above 430° C. and the duration of the isothermic holding at T_B1 no more than 245 seconds, preferably at most 200 seconds, particularly preferably at most 150 seconds.

By heating to the second treatment temperature T_B2, the thermodynamic stability of the residual austenite is heated until an elongation of the austenite phase occurs locally. In this case, the accumulated C atoms are firstly received by the residual austenite. In the course of the heating, the diffusion of the carbon in the residual austenite also increases with further temperature increase. As a result, the concentration gradient of the C content at the phase boundary from primary martensite to austenite is reduced such that the carbon in the residual austenite is distributed approximately uniformly and homogeneously. In order to ensure sufficient homogenisation, the second treatment temperature T_B2 is at least 10° C., preferably at least 15° C., particularly preferably at least 20° C. above the first treatment temperature T_B1 and is at most 500° C. With the homogenisation of the carbon, the grain boundaries of the residual austenite recede such that the proportion of the residual austenite formed during the isothermic holding at the treatment temperature T_B1 decreases. The carbon is transported through the moving phase boundary in the receding residual austenite formed during the heating to the second treatment temperature T_B2. At the same time, due to the heating, the diffusability of the manganese in the region of the phase boundary is increased which leads to enrichment of manganese in the receding residual austenite. Optional holding at the treatment temperature T_B2 for a duration of up to 34 seconds has also proven advantageous for the carbon and manganese diffusion. Along the retreating austenite phase boundary, a seam develops consisting of low-manganese ferrite, which has a width of a few nanometres, in particular equal to or less than 12 nm. The low-Mn ferrite seam is primarily formed in the low-Mn regions formed as early as during the production of the hot strips in the work steps b) and c) since the ferrite formation is particularly favoured in these regions. The low-Mn ferrite seam is notably more ductile than the remaining structure constituents. In the end product, this ductile ferrite serves as the compensation zone between structure constituents plasticising at different strengths, such as for example tempered and non-tempered martensite. The low-Mn ferrite seam counteracts, together with the residual austenite, an expansion of micro cracks, whereby in particular the hole expansion is improved.

The duration of the heating to T_B1 is in the present case designated as t_BR1. t_BR1 can be determined from the quotient of the difference of the treatment temperature T_B1 and the cooling stop temperature T_Q divided by the heating rate Theta_B1:

$$t_BR1=(T_B1-T_Q)/\text{Theta}_B1$$

with t_BR1=heating duration in seconds; T_B1=treatment temperature in ° C.; T_Q=cooling stop temperature in ° C.; Theta_B1=heating rate in K/s.

In the case of faster heating at heating rates Theta_B1 greater than 100 K/s, the uniform setting of the treatment temperature T_B1 over the strip width can only be achieved with difficulty in terms of processing and regulating technology. In the case of very slow heating at heating rates Theta_B1 less than 5 K/s, the process runs very slowly and carbides are increasingly formed. However, carbon is bonded by the carbides and is then no longer available for stabilising the residual austenite. In addition, these carbides are brittle, whereby flow in the material is prevented which in turn causes a deterioration of the subsequent macroscopic properties, such as e.g. the deep-drawing conditions, the elongation at break and the hole expansion.

Complete avoidance of carbide formation is generally not possible in term of process technology. However, the length of the carbides, which influences the mechanical-technological properties of the flat steel product, are influenced via the heating rate. The heating rate Theta_B1 is between 5 and 100 K/s in order to set the length of the carbides to at most 250 nm, preferably at most 175 nm. The length of the carbides is understood as the respectively longest axis of the carbides here.

The average heating rate Theta_B2, at which the flat steel product is brought from the first treatment temperature T_B1 to the second treatment temperature T_B2 during the two-phase heating is 2 to 50 K/s. The duration, in which the flat steel product is brought from T_B1 to T_B2, is designated here as t_BR2. t_BR2 is 0 to 35 seconds. The average heat treatment rate Theta_B2 can be determined using $$\text{Theta}_B2=(T_B2-T_B1)/t_BR2$$

with Theta_B2=heat treatment rate in K/s; t_BR2=duration in which the flat steel product is brought from T_B1 to T_B2, in seconds; T_B1 or T_B2=treatment temperature in ° C.

Heating can fundamentally be carried out by means of conventional heating devices. However, the use of radiant tubes or a booster has proven particularly effective.

In work step j), the flat steel product is held isothermically at the treatment temperature T_B1 and optionally at the treatment temperature T_B2. Isothermic holding at T_B1 and optionally at T_B2 can be utilised to support the redistribution of the carbon. The flat steel product is held for a duration t_B1 between 8.5 to 245 seconds at the treatment temperature T_B1 and optionally for a duration t_B2 of up to 34 seconds at the treatment temperature T_B2. In a preferred embodiment, the duration of heating to T_B2 and the hold duration at the temperature T_B2 is here in total at most 35 seconds, i.e. therefore (t_B2+t_BR2)≤35 seconds, preferably less than 25 seconds and particularly preferably less than 20 seconds.

The entire treatment duration t_BT, during which the flat steel product is heated to T_B1, held at T_B1, heated to T_B2 and optionally held at T_B2, should be between 10 and 250 seconds. Treatment durations shorter than 10 seconds disadvantageously affect the redistribution of the carbon. Treatment durations longer than 250 seconds promote the undesired carbide formation.

During holding or directly during heating in work step j), the flat steel product can be coated in an optional work step k) of a hot dip coating in a Zn-based coating bath. The duration, with which the flat steel product is guided through the coating bath, is included in the hold time t_B2 or in the heating duration t_BR2.

To avoid losses in strength, it has proven favourable to keep the duration t_BR2 for heating to the second treatment temperature T_B2 and the hold time t_B2 short. In particular, it has proven favourable when the hold time t_B2 is zero seconds, so that the flat steel product passes from the second heating phase t_BR2 directly into the coating bath. Thus, high strength values can be particularly reliably achieved when the duration t_BR2 for the heating to T_B2 and the optionally hold time t_B2 together are at most 35 seconds, preferably less than 25 seconds and particularly preferably less than 20 seconds.

Coating baths suitable for the hot dip coating have the following composition:

≥96 wt % Zn, 0.5-2 wt % Al, 0-2 wt % Mg.

The coating baths typically have temperatures of 450-500° C.

After the optional coating in work step k) or, if work step k) is omitted, after heating and optional holding at treatment temperature T_B2 in work step j), the flat steel product is cooled in a further work step l) at a cooling rate Theta_B3 which is more than 5 K/s. The cooling rate should be more than 5 K/s in order to enable the formation of secondary martensite. Secondary martensite is understood here as the martensite formed during the cooling in work step l). Since the secondary martensite does not undergo a heat treatment, it is also designated here as non-tempered martensite.

The flat steel product manufactured according to the invention has a particularly fine-grained structure with an average grain size of less than 20 μm, which contains a total martensite proportion of at least 80 area %, of which at least 75 area % is tempered martensite and at most 25 area % is non-tempered martensite, contains at least 5 vol % of residual austenite, 0.5 to 10 area % of ferrite and at most 5 area % of bainite.

Carbides are present in the structure with a length equal to or less than 250 nm, in particular less than 250 nm, and preferably less than 175 nm. The residual austenite is surrounded by a low-Mn ferrite seam. This seam forms, in a region of the phase boundary between tempered martensite and residual austenite, a low-Mn zone, whose Mn content is at most 50%, in particular less than 50% of the average total Mn content of the flat steel product, preferably at most 30%, in particular less than 30% of the average total Mn content of the flat steel product. The width of the low-Mn ferrite seam is at least 4 nm, preferably more than 4 nm, and preferably at least 8 nm, in particular more than 8 nm. The width of the low-Mn ferrite seam is at most 12 nm, in particular less than 12 nm, and preferably at most 10 nm, in particular less than 10 nm.

In the present case, the average total Mn content of the flat steel product is equated with the average Mn content of the steel molten mass, from which the flat steel product has been produced.

Martensite: The total martensite proportion in the structure of a flat steel product according to the invention is at least 80 area %. The martensite present in the structure of a flat steel product according to the invention is, firstly, formed during the first cooling in work step h) and, secondly, during the second cooling in work step l). The martensite formed during the first cooling is also designated as primary martensite, the martensite formed during the second cooling is also designated as secondary martensite. The primary martensite is heated in work step j). The heated primary martensite is also designated as tempered martensite or as primary tempered martensite. The total of the martensite proportions of the tempered and the secondary martensite is also designated as total martensite proportion. Martensite notably contributes to the strength of the flat steel product as a hard structure constituent. The total martensite proportion is at least 80 area % in order to obtain a flat steel product with a tensile strength Rm of at least 900 M Pa.

Tempered martensite: The primary martensite, which is formed prior to heating carried out in work step j), is the source for the carbon, which diffuses during the heat treatment into the residual austenite and stabilises it. After the heat treatment, this martensite is designated as tempered martensite. Its proportion should be at least 75 area % of the total martensite proportion in order to ensure a bending angle, which is greater than 80° and a hole expansion, which is greater than 25%.

Secondary martensite: The secondary martensite develops from the residual austenite inadequately stabilised in treatment step j) and contributes to the strength. In proportions of greater than 25 area % of the total martensite proportion, the secondary martensite leads to premature crack formation during forming and must therefore be kept under 25 area %.

Residual austenite: Residual austenite is present at room temperature in the structure of a flat steel product according to the invention. Residual austenite contributes to the improvement in the elongation properties. To ensure sufficient elongation, the proportion of residual austenite should be at least 5 vol %.

Ferrite: Ferrite has a lower strength than martensite, but can support formability in low quantities. This is why the proportion of ferrite in the structure of a flat steel product according to the invention is limited to 0.5 to 10 area %. A minimum ferrite content of 0.5 area % is present in the structure through the low-Mn ferrite seam formed during the reheating, work step j).

Bainite: Bainite is also principally present during the phase conversion of the austenite. During the conversion from austenite to bainite, a part of the dissolved carbon is incorporated into the bainite and is therefore no longer available in the austenite for enrichment of the carbon. In order to provide as much carbon as possible for enrichment of the austenite, the bainite proportion should be limited to at most 5 area %. The lower the bainite content, the more reliably the mechanical properties of the flat steel product can be achieved. The mechanical properties can be particularly reliably achieved when the formation of the bainite can be completely suppressed and the bainite content is reduced to up to 0 area %.

Low-Mn ferrite seam: The residual austenite grains in the flat steel product according to the invention are surrounded by a narrow, low-Mn ferrite seam. During the heating to treatment temperature T_B1 or T_B2 and during holding at T_B1 or T_B2, a low-Mn zone develops around the residual austenite grains, which consists of a low-Mn ferrite seam. The low-Mn ferrite seam is notably more ductile than the structure constituents surrounding it. It represents a compensation zone between structure constituents plasticising at different strengths and therefore counteracts a widening of micro cracks. This leads to an improvement of the forming behaviour, in particular the hole expansion and the maximum deep-drawing properties of the end product. The Mn content is, in the low-Mn zone, at most 50%, in particular less than 50% of the average total Mn content of the flat steel product in order to achieve a hole expansion of more than 25% and a bending angle of more than 80°. This effect can be particularly reliably achieved when the Mn content in the low-Mn zone is at most 30%, in particular less than 30% of the average Mn content of the flat steel product. The width of the low-Mn ferrite seam is at least 4 nm, in particular more than 4 nm, since only from 4 nm of width can ductile compensation occur. If the low-Mn ferrite seam were narrower, the zone would no longer effectively contribute to the ductility compensation, but rather the forming would already be influenced by grain boundary effects. The ductility compensation can be particularly reliably achieved when the low-Mn ferrite seam is preferably at least 8 nm, in particular more than 8 nm wide. The width of the low-Mn ferrite seam grows with increasing treatment time during the treatment step j). Since the positive contribution of the seam is satisfied from 12 nm and with increasing treatment duration during the work step j) the danger of carbide formation increases, the width of the seam should be at most 12 nm, in particular less than 12 nm. The effect can be particularly reliably achieved when the low-Mn ferrite seam is preferably at most 10 nm, in particular less than 10 nm wide.

Carbides: Carbon is bonded by carbides. The carbon bonded in carbide form is not available for redistribution into the austenite. Carbides also have a brittle fracture behaviour. Through the brittle behaviour of the carbides, a plastic flow in the material is prevented, which leads to a deterioration of the macroscopic properties, such as for example the maximum deep-drawing conditions and/or hole expansion. The maximum length of the carbides should be equal to or less than 250 nm in order to avoid a deterioration of the elongation at break and/or the hole expansion. The mechanical-technological properties can be particularly reliably achieved when the length of the carbides is preferably less than 175 nm. The length of a carbide is understood here as its respectively longest axis. In the present case, the term "carbides" is generally understood as carbon precipitations. This concerns precipitations, in which carbon, together with elements present in the flat steel product, forms compounds such as for example iron carbides, chromium carbides, titanium carbides, niobium carbides or vanadium carbides.

The method according to the invention enables the manufacture of a flat steel product with a tensile strength Rm of 900 to 1500 MPa, a yield strength Rp02, which is equal to or more than 700 MPa and less than the tensile strength of the flat steel product, an elongation A80 of 7 to 25%, a bending angle, which is greater than 80°, a hole expansion, which is greater than 25% and a maximum deep-drawing ratio $\beta_{max}$, for which the following relationship applies:

$$\beta_{max} \geq -1.9 \cdot 10^{-6} \times (R_m)^2 + 3.5 \cdot 10^{-3} \times R_m + 0.5$$

where Rm is the Tensile strength of the flat steel product in MPa.

In a preferred embodiment, the flat steel product has a balanced ratio of high strength and good deep-drawing behaviour. In this case, the maximum deep-drawing ratio is $\beta_{max}$ at least 1.475. A flat steel product according to the invention therefore has both good strength and forming properties.

FIG. 1 schematically shows a possible variant of the method according to the invention. In this case, the cold-rolled and uncoated flat steel product is heated to and held at a holding temperature T_HZ before it is cooled at a cooling rate Theta_Q1 in one phase to a cooling stop temperature T_Q. After isothermic holding at T_Q, the flat steel product is heated in a first heating step to the treatment temperature T_B1 at which it is isothermically held. Then, it is heated to a second treatment temperature T_B2 at which it is once again held before it is cooled to room temperature.

Figure 2:
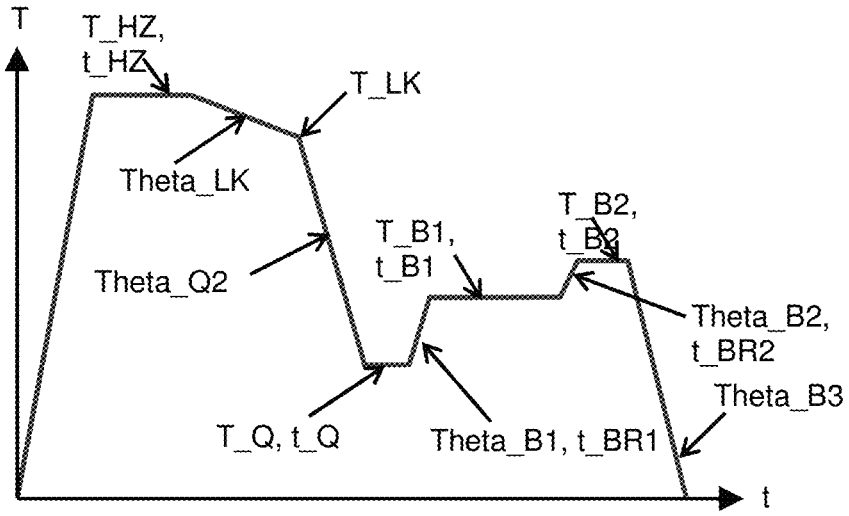
FIG. 2 schematically shows another embodiment of a heating profile used in the method according to the invention.

FIG. 2 schematically shows a further variant of the method according to the invention. In this case, the cold-rolled and uncoated flat steel product is also heated to and held at a holding temperature T_HZ before it is firstly cooled at a first, slower cooling rate Theta_LK to an intermediate temperature T_LK and then cooled at a second, faster cooling rate Theta_Q2 to the cooling stop temperature T_Q. Then, the flat steel product is, as already explained in relation to FIG. 1, heated in two phases and then cooled to room temperature.

Each of the described variants can also be combined with a hot dip coating treatment. In this case, the hot dip coating is included in the isothermic holding at the treatment temperature T_B2 or in the time period t_BR2 during the heating to the treatment temperature T_B2 before the flat steel product is cooled to room temperature.

The invention has been tested on the basis of a plurality of exemplary embodiments. To this end, 14 tests have been carried out. In this case, samples of 14 cold-rolled and coated steel strips were examined which were produced from the steels A-G indicated in Table 1. To this end, slabs of molten mass of the compositions indicated in Table 1 were firstly produced in a conventional manner. The slabs were each heated before hot rolling to a temperature of 1000-1300° C. and rolled into hot strips in an otherwise conventional manner under the conditions indicated in Table 2 and wound into hot strip coils. The hot strips were subjected in a conventional manner to pickling and then cold-rolled in a similarly conventional manner.

The conditions are indicated in Table 3 under which the samples were each heat-treated. The cold-rolled flat steel products were each heated in one phase at the heating rate Theta_H1 indicated in Table 3 to the holding zone temperature H_HZ and held for 5 to 15 seconds at the temperature T_HZ. Then, the flat steel products were each cooled in two phases firstly at a first cooling rate Theta_LK, which was more than 0.1 K/s and equal to or less than 30 K/s, to the intermediate temperature T_LK and then cooled at a second cooling rate Theta_Q2 to the cooling stop temperature T_Q. The flat steel products were held at T_Q for between >1 second and 60 seconds and then heated at a first heating speed Theta_B1 for a duration t_BR1 to a first treatment temperature T_B1. After heating, the flat steel products were held for a duration t_B1 at T_B1 and then heated at a second heating speed Theta_B2 for a duration t_BR2 to the second treatment temperature T_B2, at which they were directly introduced into a Zn-based coating bath. The flat steel products were continuously guided through a coating bath which had a composition of 96% Zn, 0.5-2% Al, 0-2% Mg. The time t_B2, which also includes passing the flat steel products through the coating bath, and the total treatment duration are also indicated in Table 3. After coating, the flat steel products were cooled at a cooling rate Theta_B3 of more than 5 K/s.

After cooling, samples were taken for structure examination and to determine the mechanical properties. The structure was in each case examined at three cross sections, which were taken equidistantly over the width of the flat steel product. The structure examination was carried out in each case over the thickness of the flat steel product at at least three equidistantly spaced points. A structure assessment by means of conventional photo-optical examination methods was not possible due to the very fine-grained structure. Therefore, the proportions of the primary, tempered martensite (M(PRI) M_1), of the secondary martensite (M(SEK) M_2), of the ferrite (F) and of the bainite (B) were examined with the aid of a scanning electron microscope (SEM) at at least 5000 times magnification. The quantitative determination of the residual austenite proportion took place by means of X-ray diffraction (XRD) according to ASTM E975. The description of the low-Mn ferrite seam and the measurement of the Mn content of the low-Mn ferrite seam were carried out by means of a tomographic atomic probe (atom probe tomography, APT). In this way, the width of the low-Mn ferrite seam, which is designated in Table 4 with Mn border, was also determined. To determine the Mn content of the low-Mn ferrite, the number of atoms was determined in a defined volume element e.g. a cylinder or a cuboid. To determine the width of the low-Mn ferrite seam, a width measurement of the seam was carried out at at least three different points of a sample. The individual values were arithmetically averaged and represent the variable designated as the width of the low-Mn ferrite seam. The Mn content of the low-Mn ferrite is designated in Table 4 as the Mn content border. The length of the carbides was determined by means of TEM. The results of the structure examinations are represented in Table 4.

The results of the testing of the mechanical properties are represented in Table 5. The mechanical properties were each examined on samples which were each taken at three points distributed equidistantly over the length of the flat steel product in the middle of the width of the flat steel product. In this case, the yield strength Rp02, the tensile strength Rm and the elongation A80 in the tensile test according to DIN EN ISO 6892-1 (sample shape 2) from February 2017 were determined. The bending angle was determined according to VDA238-100 from December 2010, the hole expansion (HER) was determined according to ISO 16630 from October 2017 and the maximum deep-drawing ratio $\beta_{max}$ was determined according to DIN 8584-3 from September 2003.

The results show that tests using the method carried out according to the invention lead to high strengths and also to good forming properties. Thus, the samples B2, B3, D7, D9, F12, F13 and G14 show bending angles greater than 80° and hole expansion values of greater than 25%. Test Al shows that in the case of a silicon content not according to the invention the structure according to the invention could not be set. The high proportion of secondary martensite and the high proportion of ferrite led to a comparatively low yield strength and tensile strength. Furthermore, only a very narrow low-Mn ferrite seam was present such that only a low bending angle and a low hole expansion were also achieved. Test B4 shows that in spite of steel composition according to the invention the formability is impaired when the rolling end temperature T_ET and the cooling stop temperature T_Q are not in accordance with the invention and the low-Mn ferrite seam is too narrow. The yield strength and the tensile strength are indeed sufficiently high, but the bending angle and the hole expansion are too low due to the excessively low Mn depletion in the low-Mn ferrite seam or the excessively low Mn enrichment in the zone adjoining the low-Mn ferrite seam.

The tests C5 and C6 show that, in the case of an excessively low carbon and silicon content, the proportion of bainite (test C5) or of secondary martensite and ferrite (test C6) is too high and the width of the low-Mn ferrite seam is too low in order to be able to achieve a sufficiently high hole expansion (test C5) or a sufficient yield strength, bending angle and hole expansion (test C6).

Test D8 shows that in spite of the steel composition according to the invention the formability is impaired by excessively long carbides when the coiling temperature T_HT is too high, the heating rate Theta_B1 is too low and the heat treatment duration t_BT is too long overall. A t_BT that is selected to be excessively long leads to an exceedance of the maximum carbide length, which negatively affects the hole expansion.

Test E10 shows that, in the case of excessively low silicon content and excessively long time period for cooling after the hot rolling at coiling temperature t_RG, the proportion of secondary martensite and the proportion of ferrite increases, which leads to an inhomogeneous structure and therefore to an insufficient bending angle and to an insufficient hole expansion.

Test E11 shows that, in the case of excessively low silicon content and coiling temperature not in accordance with the invention, the proportion of secondary martensite increases and the carbides become too long which impairs the elongation A80 and the hole expansion. Test E11 also shows that both an excessively low coiling temperature and an exceedance of the treatment duration at T_B2, thus t_BR2+t_B2>35 seconds negatively affects the properties of the flat steel product. If there is no success in sufficiently suppressing the carbide formation, then excessively long carbides are formed and premature crack formation and accordingly poor values for the hole expansion result.

TABLE 1

| Molten mass | C | Si | Mn | P | S | Al | Cr | Cu | Nb | Mo | N | Ti | V | Ni | B |
|---|---|---|---|---|---|---|---|---|---|---|---|---|---|---|---|
| A | 0.142 | 0.21 | 1.63 | 0.012 | 0.0027 | 0.031 | 0.780 | 0.051 | 0.002 | 0.003 | 0.0027 | 0.037 | 0.002 | 0.034 | 0.0011 |
| B | 0.218 | 1.48 | 2.21 | 0.016 | 0.0023 | 0.024 | 0.173 | 0.047 | 0.001 | 0.010 | 0.0046 | — | — | 0.036 | 0.0004 |
| C | 0.072 | 0.26 | 2.59 | 0.013 | 0.0021 | 0.029 | 0.690 | 0.090 | 0.001 | 0.110 | 0.0025 | 0.079 | 0.005 | 0.030 | 0.0013 |
| D | 0.158 | 1.18 | 1.99 | 0.014 | 0.0020 | 0.017 | 0.022 | — | — | — | 0.0016 | 0.015 | 0.001 | — | 0.0015 |
| E | 0.153 | 0.42 | 2.35 | 0.013 | 0.0025 | 0.710 | 0.720 | 0.061 | 0.027 | 0.010 | 0.0042 | 0.023 | 0.003 | 0.041 | 0.0014 |
| F | 0.246 | 1.47 | 2.26 | 0.011 | 0.0022 | 0.023 | 0.153 | — | — | 0.054 | 0.0030 | — | — | — | — |
| G | 0.202 | 1.40 | 2.80 | 0.011 | 0.0022 | 0.023 | 0.030 | 0.039 | — | — | 0.0037 | 0.021 | — | 0.030 | 0.0007 |

Data in wt %, remainder iron and unavoidable impurities.
Underlined values are outside of the specifications according to the invention.

TABLE 2

| Sample | Molten mass | T_ET [° C.] | t_RG [s] | T_HT [° C.] | m_CG [1000 kg] |
|---|---|---|---|---|---|
| A1 | A | 910 | 19 | 610 | 24 |
| B2 | B | 900 | 21 | 570 | 22 |
| B3 | B | 900 | 22 | 560 | 23 |
| B4 | B | 830 | 17 | 560 | 20 |
| C5 | C | 920 | 20 | 570 | 12 |
| C6 | C | 930 | 29 | 520 | 17 |
| D7 | D | 920 | 18 | 540 | 27 |
| D8 | D | 930 | 19 | 650 | 28 |
| D9 | D | 900 | 14 | 580 | 25 |
| E10 | E | 910 | 27 | 510 | 28 |
| E11 | E | 870 | 18 | 380 | 11 |
| F12 | F | 905 | 20 | 550 | 17 |
| F13 | F | 895 | 17 | 575 | 18 |
| G14 | G | 920 | 22 | 515 | 15 |

Underlined values are outside of the specifications according to the invention

TABLE 3

| Sample | Theta_H [K/s] | T_HZ [° C.] | T_LK [° C.] | T_Q [° C.] | Theta_Q2 [K/s] | T_B1 [° C.] | Theta_B1 [K/s] | t_BR1 [s] | t_B1 [s] | T_B2 [° C.] | Theta_B2 [K/s] | t_BR2 [s] | t_B2 [s] | t_BT [s] |
|---|---|---|---|---|---|---|---|---|---|---|---|---|---|---|
| A1 | 5 | 890 | 689 | 403 | 31 | 420 | 3 | 5.7 | 70 | 460 | 50 | 0.8 | 15 | 91.5 |
| B2 | 4 | 895 | 651 | 335 | 34 | 395 | 5.5 | 10.9 | 45 | 455 | 42 | 1.4 | 22 | 79.3 |
| B3 | 4 | 905 | 657 | 325 | 36 | 405 | 20.5 | 3.9 | 65 | 455 | 45 | 1.1 | 25 | 95.0 |
| B4 | 6 | 890 | 693 | 421 | 31 | 438 | 12 | 1.4 | 23 | 463 | 35 | 0.7 | 28 | 53.1 |
| C5 | 7 | 855 | 670 | 390 | 30 | 413 | 3 | 7.7 | 75 | 459 | 10 | 4.6 | 26 | 113.3 |
| C6 | 5 | 790 | 650 | 390 | 26 | 441 | 29 | 1.8 | 15 | 462 | 25 | 0.8 | 17 | 34.6 |
| D7 | 4 | 882 | 690 | 286 | 35 | 389 | 34 | 3.0 | 80 | 454 | 29 | 2.2 | 21 | 106.3 |
| D8 | 6 | 890 | 700 | 320 | 32 | 402 | 0.5 | 164 | 156 | 467 | 21 | 3.1 | 35 | 358.1 |
| D9 | 6 | 880 | 705 | 295 | 37 | 393 | 43 | 2.3 | 110 | 451 | 32 | 1.8 | 30 | 144.1 |
| E10 | 8 | 810 | 650 | 405 | 32 | 435 | 6 | 5.0 | 90 | 462 | 38 | 0.7 | 31 | 126.7 |
| E11 | 4 | 895 | 630 | 375 | 39 | 405 | 4.5 | 6.7 | 85 | 449 | 30 | 1.5 | 50 | 143.1 |
| F12 | 4 | 905 | 755 | 327 | 38 | 410 | 11 | 7.5 | 57 | 462 | 12 | 4.3 | 0 | 68.8 |
| F13 | 8 | 891 | 683 | 295 | 43 | 349 | 5 | 10.8 | 54 | 447 | 15 | 6.5 | 25 | 96.3 |
| G14 | 6 | 905 | 679 | 267 | 47 | 395 | 18 | 7.1 | 59 | 456 | 24 | 2.5 | 12 | 80.6 |

Underlined values are outside of the specifications according to the invention.

TABLE 4

| Sample | M(PRI) M_1 [area %] | M(SEK) M_2 [area %] | F [area %] | B [area %] | RA [vol %] | Mn border [nm] | Mn content border [%] | Carbide length [nm] |
|---|---|---|---|---|---|---|---|---|
| A1 | 35 | 45 | 15 | 2 | 3 | 1 | 0.31 | 50 |
| B2 | 70 | 10 | 8 | 0 | 12 | 7 | 0.58 | 120 |
| B3 | 80 | 8 | 1 | 0 | 11 | 9 | 0.64 | 150 |
| B4 | 50 | 40 | 0 | 2 | 8 | 2 | 0.41 | 90 |
| C5 | 45 | 20 | 0 | 29 | 6 | 2 | 0.62 | 130 |
| C6 | 25 | 55 | 15 | 2 | 3 | 1 | 0.61 | 150 |
| D7 | 70 | 17 | 2 | 1 | 10 | 10 | 0.57 | 140 |
| D8 | 80 | 11 | 0 | 0 | 9 | 12 | 0.79 | 310 |
| D9 | 65 | 15 | 5 | 1 | 14 | 9 | 0.86 | 130 |
| E10 | 40 | 42 | 15 | 0 | 3 | 2 | 1.02 | 195 |
| E11 | 45 | 47 | 5 | 0 | 3 | 4 | 1.13 | 265 |

TABLE 4-continued

| Sample | M(PRI) M_1 [area %] | M(SEK) M_2 [area %] | F [area %] | B [area %] | RA [vol %] | Mn border [nm] | Mn content border [%] | Carbide length [nm] |
|---|---|---|---|---|---|---|---|---|
| F12 | 70 | 15 | 3 | 0 | 12 | 11 | 0.51 | 140 |
| F13 | 85 | 5 | 2 | 0 | 8 | 8 | 0.65 | 125 |
| G14 | 90 | 0 | 4 | 0 | 6 | 8 | 0.63 | 90 |

Underlined values are outside of the specifications according to the invention.

TABLE 5

| Sample | Rp02 [MPa] | Rm [MPa] | A80 [%] | Bending [°] | HER [%] | βmax [-] |
|---|---|---|---|---|---|---|
| A1 | 580 | 897 | 15 | 67 | 12 | 2.0 |
| B2 | 870 | 1199 | 16 | 95 | 37 | 2.1 |
| B3 | 935 | 1185 | 14 | 116 | 42 | 2.0 |
| B4 | 728 | 1254 | 11 | 58 | 7 | 1.9 |
| C5 | 715 | 1103 | 11 | 81 | 24 | 2.1 |
| C6 | 685 | 1124 | 14 | 72 | 19 | 2.1 |
| D7 | 902 | 1075 | 15 | 139 | 49 | 2.2 |
| D8 | 867 | 1027 | 12 | 63 | 4 | 1.7 |
| D9 | 848 | 1091 | 18 | 128 | 37 | 2.1 |
| E10 | 714 | 1238 | 9 | 76 | 12 | 1.8 |
| E11 | 869 | 1213 | 6 | 92 | 18 | 1.6 |
| F12 | 1005 | 1379 | 18 | 97 | 32 | 1.8 |
| F13 | 1283 | 1358 | 16 | 119 | 35 | 1.9 |
| G14 | 1098 | 1189 | 17 | 112 | 31 | 2.1 |

Underlined values are outside of the specifications according to the invention

The invention claimed is:

1. A flat steel product consisting of, in wt %,
0.1-0.5% C,
1.0-3.0% Mn,
0.9-1.5% Si,
up to 1.5% Al,
up to 0.008% N,
up to 0.020% P,
up to 0.005% S,
0.01-1% Cr,
as well as optionally consisting of one or more of the following elements
up to 0.2% Mo,
up to 0.01% B,
up to 0.5% Cu,
up to 0.5% Ni,
as well as optionally consisting of in total 0.005-0.2% of Ti, Nb, and V,
and iron as a remainder and unavoidable impurities, wherein the following applies:

$$75 \leq (Mn^2+55*Cr)/Cr \leq 3000$$

where Mn is the Mn content of the flat steel product in wt %, and Cr is the Cr content of the flat steel product in wt %, the flat steel product having a structure, consisting of
at least 80 area % martensite, of which at least 75 area % is tempered martensite and at most 25 area % is non-tempered martensite,
at least 5% by volume residual austenite,
0.5 to 10 area % ferrite, and
at most 5 area % bainite,
wherein in a region of a phase boundary between tempered martensite and residual martensite, there is a low-Mn ferrite seam which has a width of at least 4 nm and at most 12 nm and a Mn content of at most 50% of an average total Mn content of the flat steel product, and
wherein the flat steel product has carbides, and a length of the carbides are equal to or less than 250 nm.

2. The flat steel product according to claim 1, wherein the flat steel product has a tensile strength of 900 to 1500 MPa, a yield strength Rp02 of more than 700 MPa, an elongation A80 of 7 to 25%, a bending angle of greater than 80°, a hole expansion of greater than 25% and a maximum deep-drawing ratio $\beta_{max}$ for which the following applies:

$$\beta_{max} \geq -1.9 \cdot 10^{-6} \times (R_m)^2 + 3.5 \cdot 10^{-3} \times R_m + 0.5$$

where Rm is the tensile strength of the flat steel product in MPa.

3. A flat steel product according to claim 1, wherein the width of the low-Mn ferrite seam is at least 8 nm and at most 12 nm.

4. The flat steel product according to claim 1, wherein the width of the low-Mn ferrite seam is at least 4 nm and at most 10 nm.

5. The flat steel product according to claim 1, wherein the Mn content of the low-Mn ferrite seam is at most 30% of the average total Mn content of the flat steel product.

6. The flat steel product according claim 1, wherein the length of the carbides is less than 175 nm.

7. The flat steel product according to claim 2, wherein the flat steel product has a maximum deep-drawing ratio $\beta_{max}$ of at least 1.475.

8. The flat steel product according to claim 1, wherein the flat steel product is provided with a metallic coating.

* * * * *